US006260744B1

(12) United States Patent
Bellefleur

(10) Patent No.: US 6,260,744 B1
(45) Date of Patent: Jul. 17, 2001

(54) BOW ASSEMBLY AND METHOD OF MAKING

(76) Inventor: Susan I. Bellefleur, 65 Farmholme Rd., Stonington, CT (US) 06378

( * ) Notice: Subject to any disclaimer, the term of this patent is extended or adjusted under 35 U.S.C. 154(b) by 0 days.

(21) Appl. No.: 09/667,025

(22) Filed: Sep. 21, 2000

(51) Int. Cl.[7] ..... A41H 43/00
(52) U.S. Cl. ..... 223/46; 428/4
(58) Field of Search ..... 223/44, 46; 28/147; 428/4

(56) References Cited

U.S. PATENT DOCUMENTS

D. 327,574 7/1992 Hoff .
2,845,736 * 8/1958 Crawford ..... 223/46
3,501,364 * 3/1970 Rowland ..... 223/46
3,637,455 1/1972 Pearson et al. .
4,627,640 12/1986 Markovics .
5,116,687 5/1992 Asano et al. .
5,240,750 8/1993 Cheng .
5,679,416 * 10/1997 Cheng ..... 428/5
5,691,023 11/1997 Keller .
5,693,381 * 12/1997 Cheng ..... 428/5

* cited by examiner

*Primary Examiner*—Bibhu Mohanty

(57) ABSTRACT

A bow assembly and method of making for providing a simple yet elegant decoration. The bow assembly and method of making includes a plurality of ribbon pieces each having a unique length and a pair of coupling members.

20 Claims, 2 Drawing Sheets

BOW ASSEMBLY AND METHOD OF MAKING

BACKGROUND OF THE INVENTION

1. Field of the Invention

The present invention relates to decorative bows and more particularly pertains to a new bow assembly and method of making for providing a simple yet elegant decoration.

2. Description of the Prior Art

The use of decorative bows is known in the prior art. More specifically, decorative bows heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,240,750; U.S. Pat. No. 5,116,687; U.S. Pat. No. 3,637,455; U.S. Pat. No. 4,627,640; U.S. Pat. No. 5,691,023; and U.S. Pat. No. Des. 327,574.

While these devices fulfill their respective, particular objectives and requirements, the aforementioned patents do not disclose a new bow assembly and method of making. The inventive device includes a plurality of ribbon pieces each having a unique length and a pair of coupling members.

In these respects, the bow assembly and method of making according to the present invention substantially departs from the conventional concepts and designs of the prior art, and in so doing provides an apparatus primarily developed for the purpose of providing a simple yet elegant decoration.

SUMMARY OF THE INVENTION

In view of the foregoing disadvantages inherent in the known types of decorative bows now present in the prior art, the present invention provides a new bow assembly and method of making construction wherein the same can be utilized for providing a simple yet elegant decoration.

The general purpose of the present invention, which will be described subsequently in greater detail, is to provide a new bow assembly and method of making apparatus and method which has many of the advantages of the decorative bows mentioned heretofore and many novel features that result in a new bow assembly and method of making which is not anticipated, rendered obvious, suggested, or even implied by any of the prior art decorative bows, either alone or in any combination thereof.

To attain this, the present invention generally comprises a plurality of ribbon pieces each having a unique length and a pair of coupling members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bow assembly and method of making apparatus and method which has many of the advantages of the decorative bows mentioned heretofore and many novel features that result in a new bow assembly and method of making which is not anticipated, rendered obvious, suggested, or even implied by any of the prior art decorative bows, either alone or in any combination thereof.

It is another object of the present invention to provide a new bow assembly and method of making which may be easily and efficiently manufactured and marketed.

It is a further object of the present invention to provide a new bow assembly and method of making which is of a durable and reliable construction.

An even further object of the present invention is to provide a new bow assembly and method of making which is susceptible of a low cost of manufacture with regard to both materials and labor, and which accordingly is then susceptible of low prices of sale to the consuming public, thereby making such bow assembly and method of making economically available to the buying public.

Still yet another object of the present invention is to provide a new bow assembly and method of making which provides in the apparatuses and methods of the prior art some of the advantages thereof, while simultaneously overcoming some of the disadvantages normally associated therewith.

Still another object of the present invention is to provide a new bow assembly and method of making for providing a simple yet elegant decoration.

Yet another object of the present invention is to provide a new bow assembly and method of making which includes a plurality of ribbon pieces each having a unique length and a pair of coupling members.

Still yet another object of the present invention is to provide a new bow assembly and method of making that enhances the aesthetic appearance of a package and expresses the love and affection felt for the person receiving the package.

Even still another object of the present invention is to provide a new bow assembly and method of making that is suitable for any occasion and is reuseable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
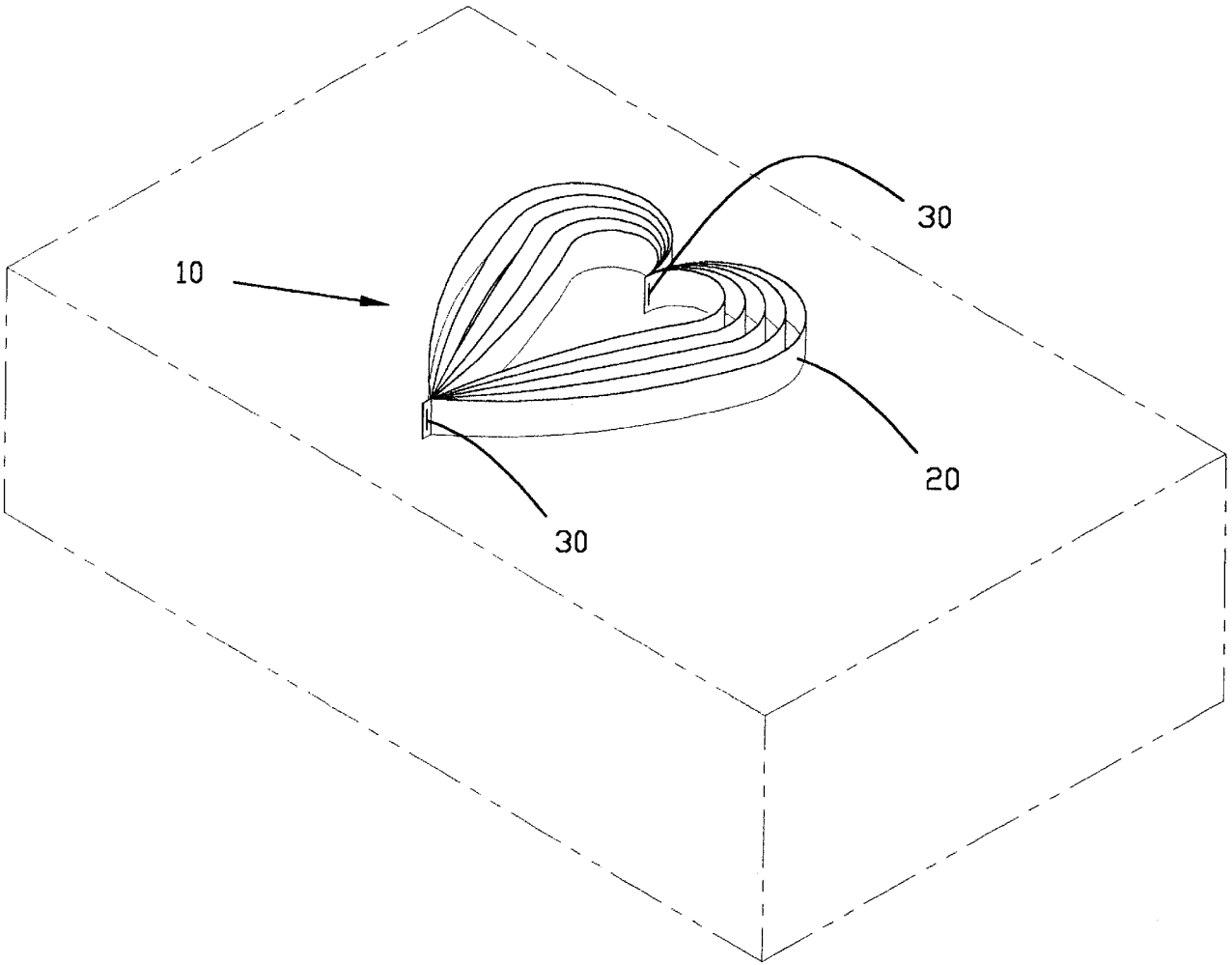
FIG. 1 is a schematic perspective view of a new bow assembly and method of making according to the present invention.
Figure 3:
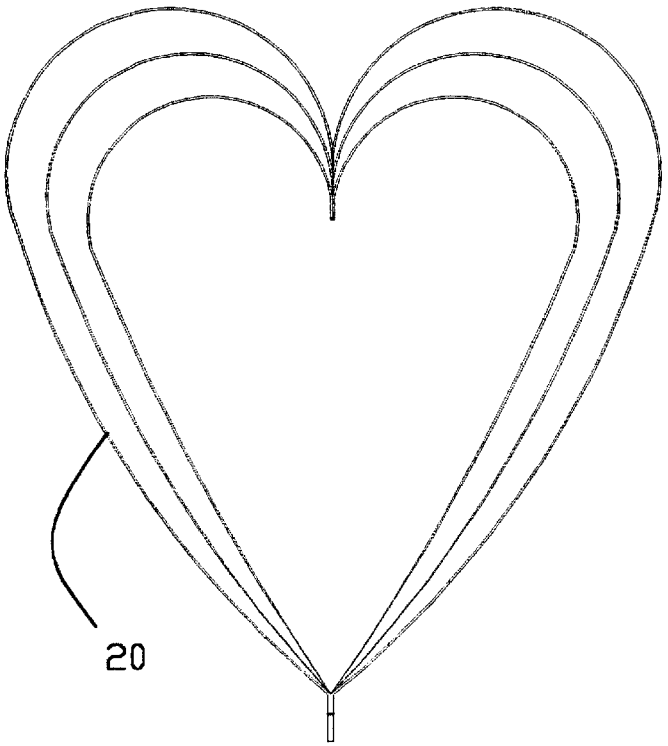
FIG. 3 is a schematic top view of an embodiment of the present invention.
Figure 2:
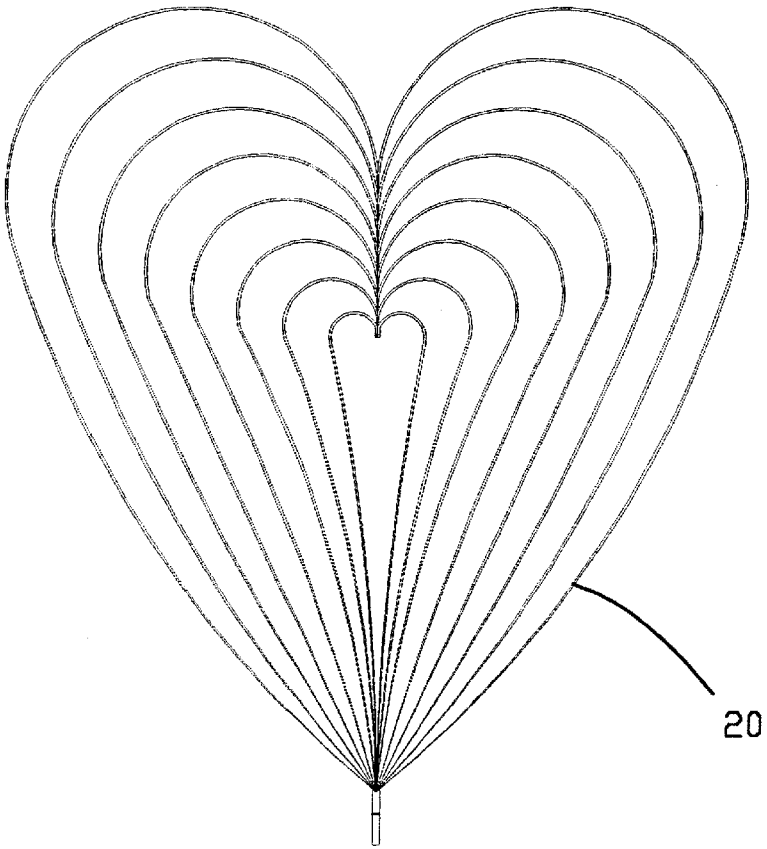
FIG. 2 is a schematic top view of the present invention.

With reference now to the drawings, and in particular to FIGS. 1 through 3 thereof, a new bow assembly and method of making embodying the principles and concepts of the present invention and generally designated by the reference numeral 10 will be described.

As best illustrated in FIGS. 1 through 3, the bow assembly and method of making 10 generally comprises a plurality of ribbon pieces 20 and a pair of coupling members 30.

In an embodiment the plurality of ribbon pieces comprises two ribbon pieces. A first one of the three ribbon pieces is about 8 inches in length. A second one of the three ribbon pieces is about 10 inches in length and a third one of the two ribbon pieces is about 12 inches in length.

In another embodiment the plurality of ribbon pieces comprises four ribbon pieces. A first one of the four ribbon pieces is about 6 inches in length. A second one of the four ribbon pieces is about 8 inches in length. A third one of the four ribbon pieces is about 10 inches in length, and a fourth one of the four ribbon pieces is about 12 inches in length.

In yet another embodiment the plurality of ribbon pieces comprises eight ribbon pieces. A first one of the eight ribbon pieces is about 14 inches long. A second one of the eight ribbon pieces is about 16 inches long. A third one of the eight ribbon pieces is about 18 inches long. A fourth one of the eight ribbon pieces is about 20 inches long. A fifth one of the eight ribbon pieces is about 22 inches long. A sixth one of the eight ribbon pieces is about 24 inches long and a seventh one of the eight ribbon pieces is about 26 inches long and an eighth one of eight ribbon pieces is about 28 inches long.

The table shown below illustrates only a few of the combinations for making bow assemblies of various sizes.

| Bow Assembly Size | Bow Height | Bow Width | Number of Ribbons | Lengths of Ribbons |
|---|---|---|---|---|
| 1½ inch | 1½ inch | 1¼ inch | 3 | 3, 4, 5 |
| 3 inch | 3 inch | 3 inch | 4 | 12, 10, 8, 6 |
| 3 inch | 3 inch | 3 inch | 3 | 12, 10, 8 |
| 4 inch | 4 inch | 4⅛ inch | 5 | 16, 14, 12, 10, 8 |

-continued

| Bow Assembly Size | Bow Height | Bow Width | Number of Ribbons | Lengths of Ribbons |
|---|---|---|---|---|
| 4 inch | 4 inch | 4⅛ inch | 3 | 16, 12, 8 |
| 5 inch | 5 inch | 5¼ inch | 6 | 20, 18, 16, 14, 12, 10 |
| 5 inch | 5 inch | 5¼ inch | 4 | 20, 16, 12, 8 |
| 5 inch | 5 inch | 5¼ inch | 3 | 20, 16, 12 |
| 7 inch | 7 inch | 7¼ inch | 8 | 28, 26, 24, 22, 20, 18, 16, 14 |
| 7 inch | 7 inch | 7¼ inch | 4 | 28, 24, 20, 16 |

In use, ribbon and a pair of coupling devices are provided. The ribbon is cut into a plurality of pieces. Each of the ribbon pieces has a unique length. Each one of the pieces of ribbon is creased along the center of its length. The creased centers of each of the pieces of ribbon are aligned such that the centers abut an adjacently positioned center. The centers are then coupled together using one of the pair of coupling devices. The free ends of all of the ribbon pieces are gathered together and aligned such that each edge of all of the free ends is aligned. The free ends are then coupled together using the second of the pair of coupling devices.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of making a bow assembly, the steps of the method comprising:

providing ribbon and a coupling device;

cutting said ribbon into a plurality of ribbon pieces, each of said ribbon pieces being of a unique length with respect to said other ribbon pieces;

creasing a center of each of said ribbon pieces;

aligning said creased centers of each of said ribbon pieces such that each said center abuts an adjacently positioned center;

coupling said centers together;

gathering free ends of each of said ribbon pieces together such that an edge of each free end is aligned with each other edge of said free ends; and coupling said free ends together.

2. The method of claim 1, wherein said coupling device is a stapler, the steps of the method further comprising:

folding said ribbon pieces over each other such that said centers abut each other; and coupling said centers together by stapling said ribbon pieces together proximate said centers of said ribbon pieces.

3. The method of claim 1, wherein said ribbon is provided on a roll such that said ribbon has a curvature along a length of said ribbon; and wherein creasing said center of said ribbon pieces further comprises:

creasing each said ribbon piece at a center of said ribbon piece by folding said ribbon piece against said curvature such that said free ends of said ribbon piece curve away from each other after each said ribbon piece has been creased.

4. The method of claim 1, wherein said coupling device is a stapler, the steps of the method further comprising:

coupling said free ends to each other by stapling said free ends together.

5. The method of claim 1, the steps of the method further comprising:

cutting said ribbon into a first ribbon piece;

cutting said ribbon into a plurality of subsequent ribbon pieces such that each subsequent ribbon piece is a pre-determined length longer than said ribbon piece cut immediately prior to cutting said subsequent ribbon piece;

aligning said centers such that each subsequent ribbon piece is positioned adjacent to said ribbon piece cut immediately prior to cutting said subsequent ribbon piece.

6. The method of claim 1, the steps of the method further comprising:

cutting said ribbon into a plurality of ribbon pieces including a shortest ribbon piece and a plurality of longer ribbon pieces, each longer ribbon piece being a multiple of a pre-determined length longer than said shortest ribbon piece.

7. The method of claim 6, the steps of the method further comprising:

aligning said centers such that said ribbon pieces are aligned from shortest to longest prior to coupling said centers together.

8. The method of claim 6 wherein said shortest ribbon piece is about 6 inches long;

wherein said plurality of longer ribbon pieces comprises three longer ribbon pieces; and wherein said pre-determined length is about 2 inches whereby said longer ribbon pieces are about 8 inches, 10 inches, and 12 inches long.

9. The method of claim 6 wherein said shortest ribbon piece is about 8 inches long;

wherein said plurality of longer ribbon pieces comprises two ribbon pieces; and wherein said pre-determined length is about 2 inches whereby said longer ribbon pieces are about 10 inches and 12 inches long.

10. The method of claim 6 wherein said shortest ribbon piece is about 14 inches long;

wherein said plurality of longer ribbon pieces comprises six longer ribbon pieces; and wherein said pre-determined length is about 2 inches whereby said longer ribbon pieces are about 16 inches, 18 inches, 20 inches, 22 inches, 24 inches, 26 inches, and 28 inches long.

11. The bow assembly produced by the method of claim 1.

12. The bow assembly produced by the method of claim 2.

13. The bow assembly produced by the method of claim 3.

14. The bow assembly produced by the method of claim 4.

15. The bow assembly produced by the method of claim 5.

16. The bow assembly produced by the method of claim 6.

17. The bow assembly produced by the method of claim 7.

18. The bow assembly produced by the method of claim 8.

19. The bow assembly produced by the method of claim 9.

20. The bow assembly produced by the method of claim 10.

* * * * *